US009689108B2

(12) United States Patent
Hamman, Jr. et al.

(10) Patent No.: US 9,689,108 B2
(45) Date of Patent: Jun. 27, 2017

(54) DRYER DUCT CONNECTOR

(75) Inventors: John Frederick Hamman, Jr., Indianapolis, IN (US); Mitchell Ross Schlatter, Fishers, IN (US); Patrick Jon Foley, Fishers, IN (US); Richard Lee Ballard, Avon, IN (US)

(73) Assignee: Deflecto, LLC, Indianapolis, IN (US)

( * ) Notice: Subject to any disclaimer, the term of this patent is extended or adjusted under 35 U.S.C. 154(b) by 362 days.

(21) Appl. No.: 13/590,037

(22) Filed: Aug. 20, 2012

(65) Prior Publication Data

US 2014/0049043 A1 Feb. 20, 2014

(51) Int. Cl.
*D06F 58/20* (2006.01)
*F24F 13/02* (2006.01)

(52) U.S. Cl.
CPC ..... *D06F 58/20* (2013.01); *F24F 13/0209* (2013.01)

(58) Field of Classification Search
CPC ..... F24F 13/0209
USPC ..... 285/397, 424
See application file for complete search history.

(56) References Cited

U.S. PATENT DOCUMENTS 931,581 A * 8/1909 Doyle ..... 285/114
1,324,897 A * 12/1919 Holub ..... 285/382.1
1,661,674 A * 3/1928 Osborn ..... 285/319
4,338,731 A 7/1982 Shames et al.
4,569,110 A * 2/1986 Goettel ..... 29/890.11
5,046,408 A 9/1991 Eugenio et al.
5,133,579 A * 7/1992 Anderson ..... D06F 58/20 285/226
5,199,190 A * 4/1993 Mayer ..... D06F 58/20 285/181
5,346,264 A * 9/1994 Law et al. ..... 285/136.1
5,722,181 A 3/1998 Meyer
5,916,023 A 6/1999 Meyer
5,921,592 A * 7/1999 Donnelly ..... 285/340
5,944,060 A * 8/1999 MacKay ..... 138/140
6,370,794 B1 * 4/2002 Tuggle ..... D06F 58/20 285/147.1
6,767,280 B1 * 7/2004 Berger ..... 454/339
D518,566 S 4/2006 Bratton et al.
7,393,021 B1 * 7/2008 Lukjan ..... 285/424
2010/0201116 A1 * 8/2010 Kipker et al. ..... 285/24

FOREIGN PATENT DOCUMENTS

CA 2213141 2/1998
CA 2192762 3/1998
CA 2243015 1/1999

* cited by examiner

*Primary Examiner* — James M Hewitt
(74) *Attorney, Agent, or Firm* — Dentons US LLP; Brian R. McGinley; Roman Tsibulevskiy

(57) ABSTRACT

A connector including a first member having a cylindrical portion and a second member having a cylindrical portion that is frictionally engageable with the first member.

5 Claims, 5 Drawing Sheets

DRYER DUCT CONNECTOR

FIELD OF THE INVENTION

This invention relates to a coupler used to vent appliances.

BACKGROUND OF THE INVENTION

Appliances, and in particular clothes dryers, often include ducts to exhaust air from the appliance to an external location. In the case of dryers, the amount of thermal energy associated with the exhausted air and the confined space in which a dryer is typically placed dictates the design of the coupler used to connect an exhaust duct from the dryer to the exterior of the structure.

Typically, an exhaust duct is connected to a discharge vent using duct clamps, which can distort the shape of the exhaust duct. Other designs employ metal exhaust conduits that are attached via a telescopic fit, i.e. one end of the conduit has a larger diameter than the other end, and the ends are then attached to each other and secured by a clamp. In some instances the ends of a coupler must be twisted to cause the corresponding ends to lock into place.

These designs, however, make it difficult to install ducts and often require that the appliance be moved in order to connect, disconnect, inspect, clean or replace the duct. Accordingly, there remains a need for a coupler that easily connects and disconnects to duct, improving the installation, inspection, cleaning and replacement of an appliance duct.

SUMMARY OF THE INVENTION

Disclosed herein are one or more inventions, the embodiments which address the problems caused by appliance duct connectors. More particularly, the embodiments relate to a connector which consists of pieces that are readily connected and disconnected to each other via pressure tabs or raised cantilevered tabs.

In one embodiment of the invention, the connector includes a first member having a cylindrical portion and a second member having a cylindrical portion that is engageable with the first member. In this embodiment, the second member includes at least one pressure tab on the circumference of the second member.

In another embodiment, the connector further includes a flange that is connected to the first member. The flange is adapted to be attached to a surface.

In another embodiment the first member includes a beveled edge circumferentially located on the inside of the first member.

In another embodiment, the second member further comprises a rib circumferentially located on the second member and dividing the second member into an upper portion and a lower portion permitting only the lower portion to be engageable with the first member.

In another embodiment a plurality of pressure tabs are circumferentially located on the lower portion of the second member.

In another embodiment a plurality of pressure tabs are circumferentially located on the upper portion of the second member.

Other systems, methods, features, and advantages of the present invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE INVENTION

Figure 1:
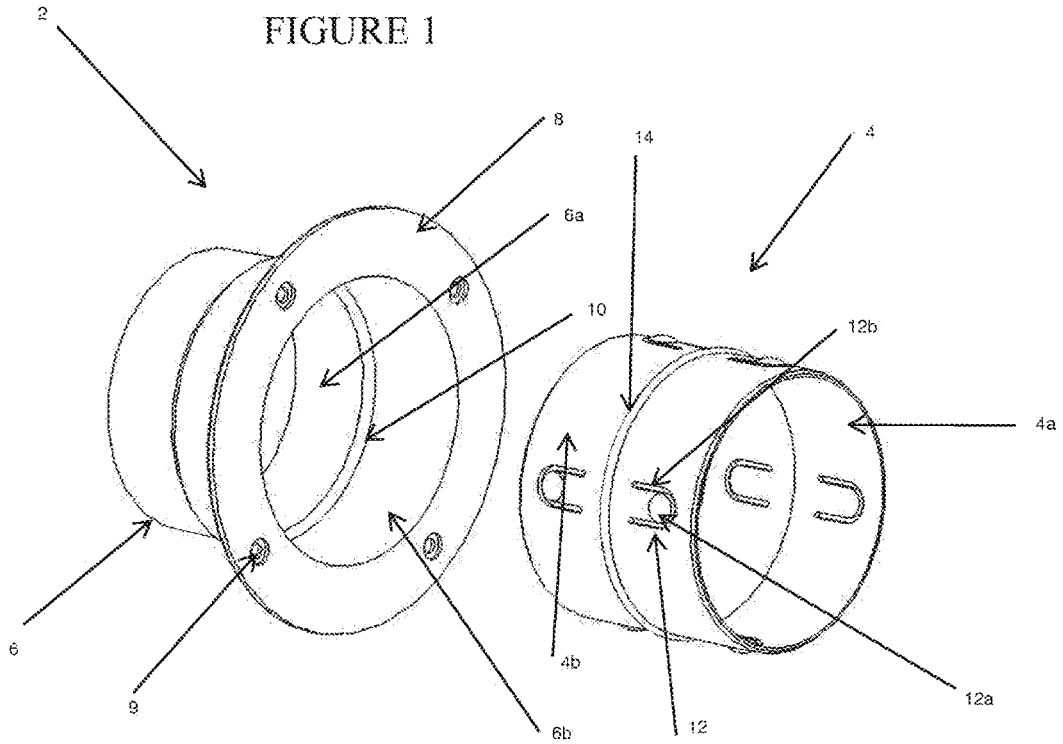
FIG. 1 depicts the first and second member of the coupler.

FIG. 1 shows a connector according to a preferred embodiment of the invention which includes a first member (2) sized to receive a second member (4). The first member (2) has cylindrical portion (6) and a flange (8). Openings (9) can be circumferentially placed around the flange (8) to permit the first member to be secured to a surface via screws or the like. The interior portion of the first member (2) may contain a beveled edge (10) circumferentially placed within the first member. The beveled edge (10) divides the cylindrical portion of the first member into an upper portion 6(*a*) and a lower portion 6(*b*). The beveled edge (10) can also be a chamfer edge, a tapered edge or a similar edge to facilitate mating with the second member. The cylindrical portion of the first member (2) can also have a telescopic shape which defines the upper portion 6(*a*), having a larger diameter than the lower portion 6(*b*). The beveled edge serves to aid in the positioning of the second member (4) within the first member (2). The beveled edge is not limited to the location shown in FIG. 1; it can be located at other points inside of the first member.

The second member (4) is cylindrical and includes at least one pressure tab or raised cantilevered tab (12) (hereinafter referred to as pressure tab) which can be formed circumferentially around the exterior of second member (4). At least one pressure tab is provided on the second member, but two, three, four, five or more pressure tabs can be provided on the second member. The pressure tab (12) is configured such that when the second member (4) is placed within the first member (2) the pressure tab (12) compresses in order to enhance the frictional interface between the members. More specifically, the pressure tab is located on the second member or the male piece of the connector and a portion of the pressure tab is bent inward by shear forces that are applied by the tapered inner walls of the first member or the female part during insertion. These forces in turn will hold the second portion (i.e. the male portion) and the first portion (i.e. the female portion) together. The pressure tab (12) is preferably U-shaped, but other suitable shapes are contemplated. Additionally, a portion of the second member can be removed from the perimeter 12(*b*) of the pressure tab thereby improving the compressibility and flexibility of the pressure tab. The pressure tab (12) can include a dimple 12(*a*) which protrudes outwardly from the surface of the pressure tab (12). The dimple 12(*a*) is preferably circular in nature, but other shapes such as a square, rectangle, or any abstract shape or the like can also be used. Injection molding is the manufacturing process used to fabricate this pressure tab.

A rib (14), which protrudes from the surface of the second member (4), is formed circumferentially around the second member. The rib (14) divides the second member into an upper portion 4(*a*) and lower portion and 4(*b*). In FIG. 1, the rib (12) is shown equidistant between the first and second ends of the second member (4), but the rib can be located at any point between the edges of the cylindrical shape.

When the second member (4) is inserted into the first member (2), the ribbed edge (14) meets the flange (8) of the first member (2) and serves as a positioning aid for the second member. In FIG. 1, the rib (14) permits only the lower portion 4(*b*) of the second member (4) to be inserted into the first member (2), leaving the upper portion 4(*a*) exposed. The upper portion 4(*a*) is then preferably attached to a duct, vent or similar exhaust means known to those of ordinary skill in the art. The ribbed edge (14) can also be a raised surface, beam or the like to facilitate mating with the first member.

Figure 2A:
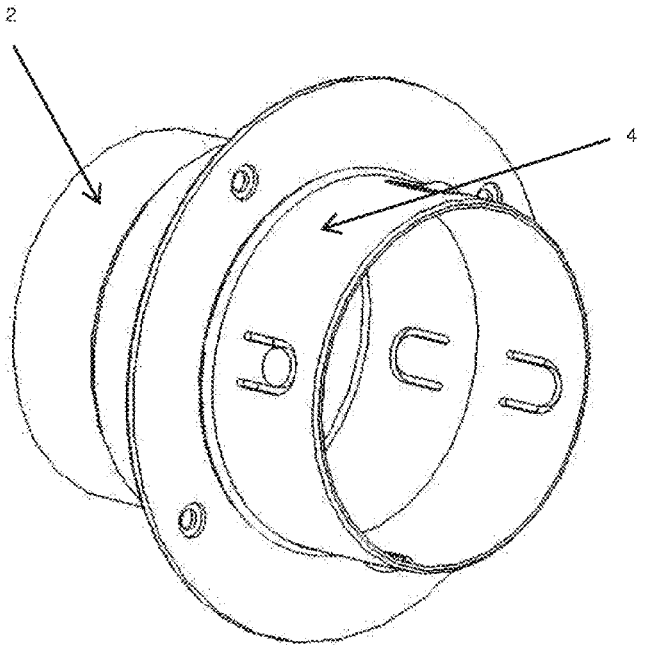
FIG. 2*a* depicts the first member and the second member engaged.
Figure 2B:
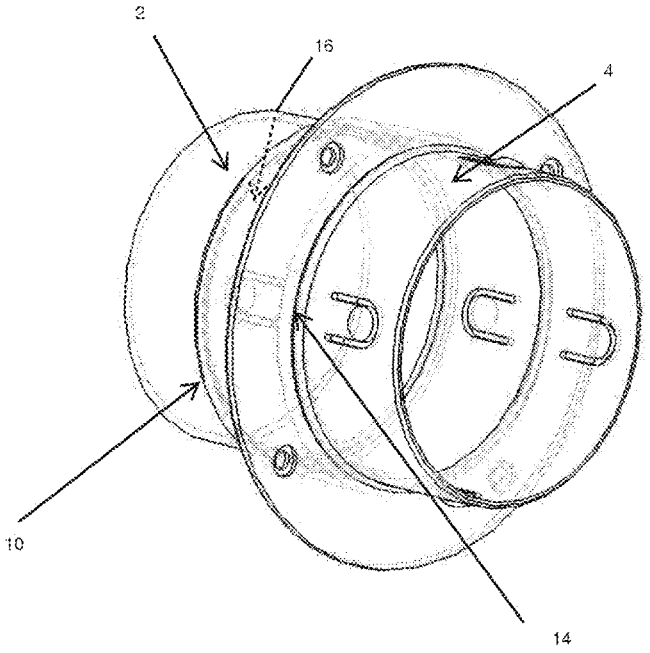
FIG. 2*b* depicts the first member and the second member engaged.

FIGS. 2*a* and 2*b* show the first member (2) engaged with the second member (4). In this embodiment, the second member slides into position within the first member. The physical contact between the inner surface of the first member and the pressure tabs located on the second member frictionally engages the first member and the second member to secure the first member and the second member together. Additional friction occurs at any point where the inner surface of the first member is in contact with the inner surface of the second member (16). In the event the second member and first member need to be disengaged, the first member can be removed from the second member by simply pulling the second member and first member away from each other with sufficient force to overcome the frictional engagement between the surfaces of the first and second member that are in contact with each other, including the pressure tab or pressure tabs.

Additionally, as shown in FIG. 2*b*, the lower portion of the second member rests on the beveled edge (10), which aids in positioning the second member within the first member and prevents the second member from being inserted too far into the first member. The rib on the second member (14) also serves as a positioning aid by preventing the second member from being inserted into the first member past the rib on the second member. The beveled edge and the rib permit the first and second member to become engaged without concern for measuring the depth of either member thereby improving the connection between the members and permitting a duct to be easily attached to the upper portion of the second member.

Figure 3:
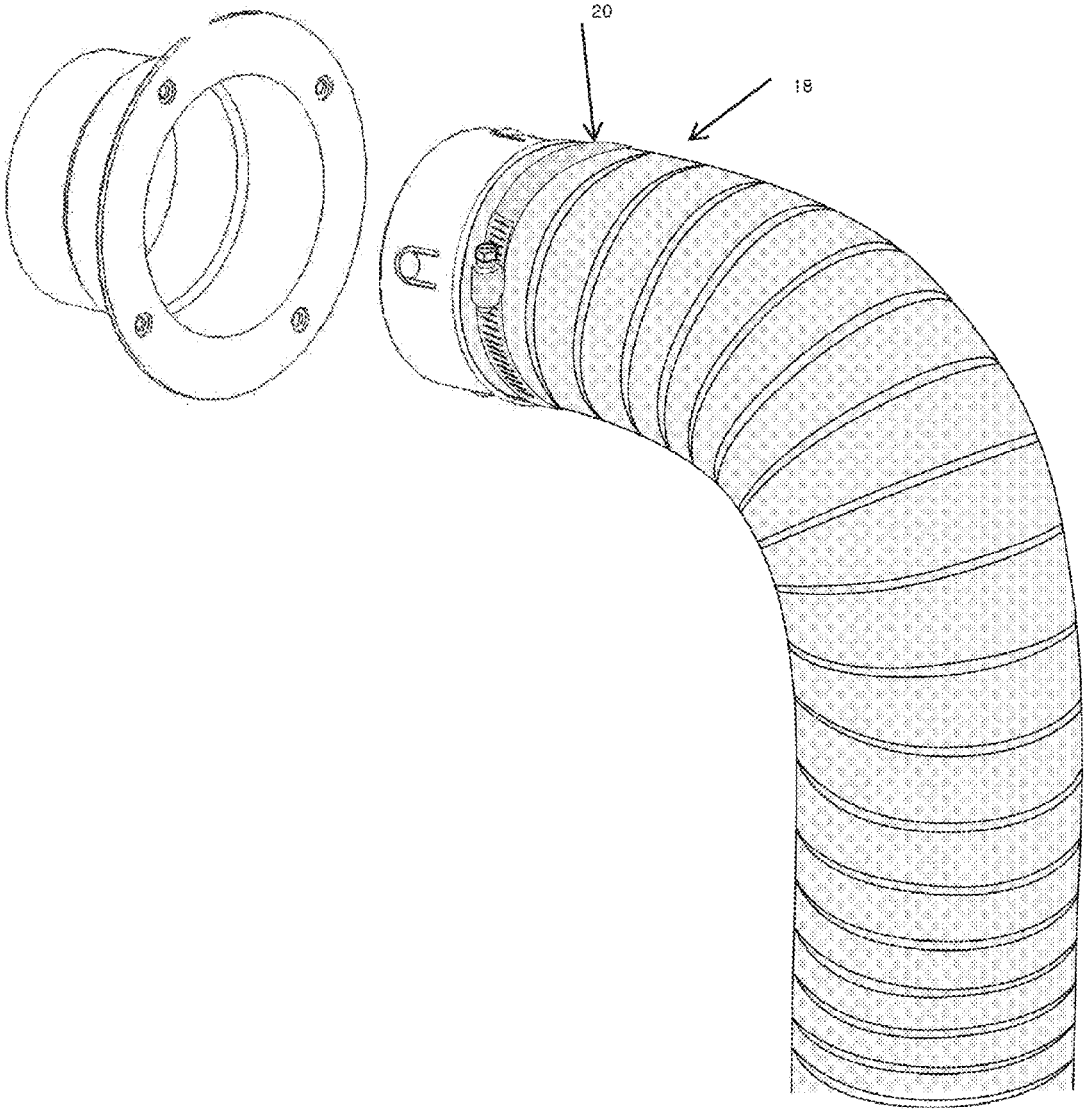
FIG. 3 depicts the first member and second member with a duct attached to the upper portion of the second member.

FIG. 3 shows the upper portion of the second member can also include pressure tabs to engage the second member with a duct (18). In this instance, the physical contact between the inner surface of the duct (18) and the pressure tabs located on the second member frictionally engages the duct and the second member to secure the second member and the duct together. Additional friction occurs at any point where the inner surface of the second member is in contact with the inner surface of the duct (18). In the event the second member and the duct need to be disengaged, the duct can removed from the second member by simply pulling the second member and the duct away from each other with sufficient force to overcome the frictional engagement between the surfaces of the duct and the second member that are in contact with each other, including the pressure tab or pressure tabs.

The length of the duct varies based on the application and location of the equipment which requires venting. The suggested maximum length for dryer duct or venting varies by manufacturer, as well as how many bends there are in the line and the type of vent/hood.

As shown in FIGS. 2*b* and 3, the pressure tabs serve as a way of frictionally engaging the second member with both the first member and the duct. The need for a clamp (20), is not necessary, but can still be employed to further tighten the fit around the second member and the duct.

Figure 4:
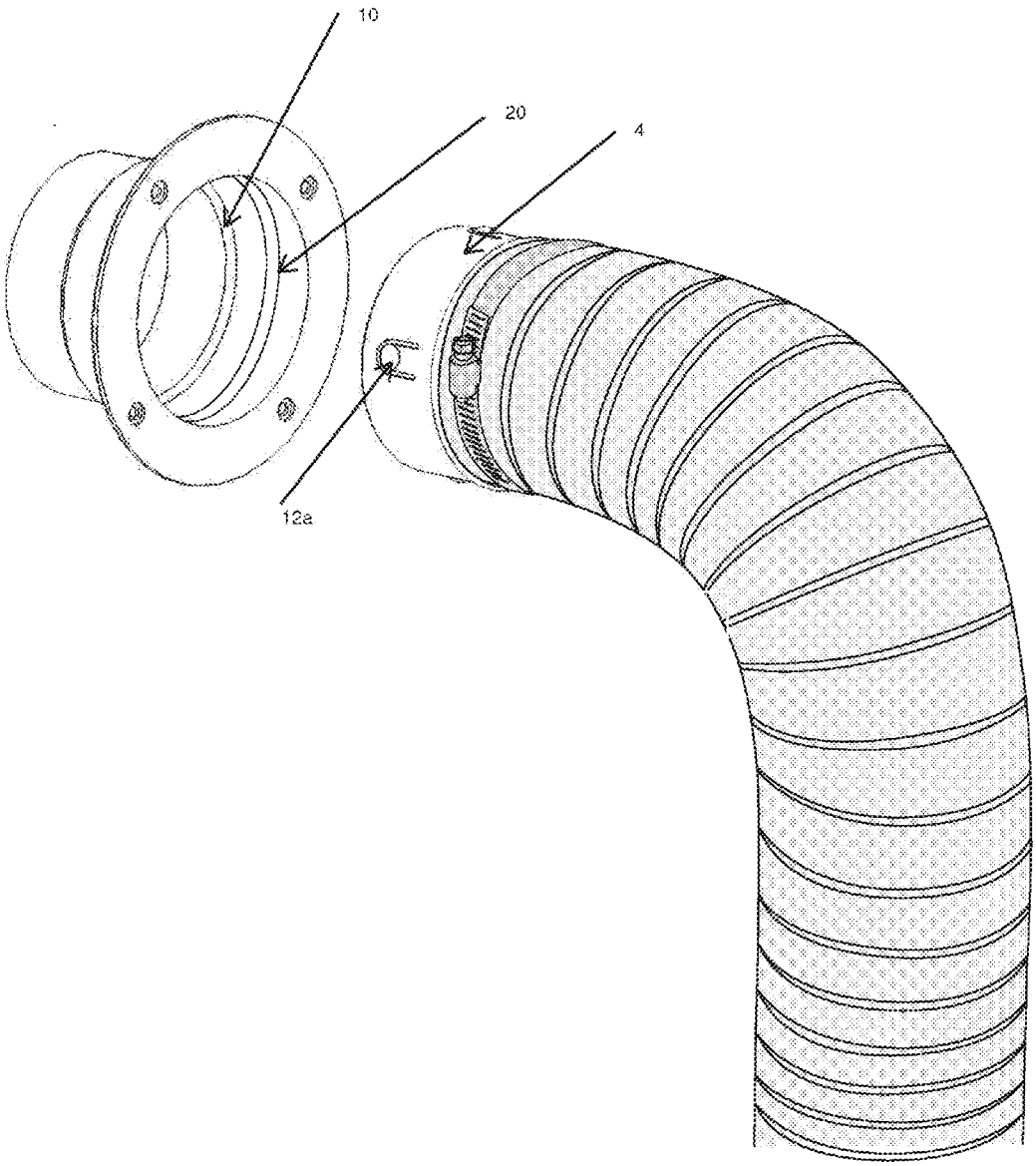
FIG. 4 depicts the first member having a groove and second member with a duct attached to the upper portion of the second member.

FIG. 4 illustrates another embodiment of the invention which includes a first member (2) sized to receive a second member (4). The interior portion of the first member (2) may contain a beveled edge (10) circumferentially placed within the first member, which serves to aid in the positioning of the second member (4) within the first member (2). Additionally, in this embodiment the interior of the first member (2) is provided with a groove (20) that corresponds to the pressure tab or pressure tabs of the second member. For example, the groove can be located at a distance that corresponds to the location of the pressure tab on the second member (4) and the groove can have a depth and width that corresponds to the raised portion of the pressure tab (12*a*). The groove (20) can extend around the entire internal circumference of the first member (2) or only a portion of the internal circumference (not shown). Additionally, the first member can be provided with more than one groove (not shown), where each groove corresponds to a pressure tab. The groove can be positioned vertically, horizontally or at another orientation that corresponds to the location of the pressure tab.

When the first member and second member are connected, the pressure tab or pressure tabs snap into place within the groove. The groove (20) therefore has a depth that is sufficient to allow the pressure tab or pressure tabs to extend and release into the groove, providing an additional frictional connection and secure connection with first member.

In another embodiment of the invention, the upper portion and lower portion of the second member each include at least one pressure tab. The pressure tab in the upper portion engages the second member with a duct (18). In this instance, the physical contact between the inner surface of the duct (18) and the pressure tab located on the upper portion of the second member frictionally engages the duct and the second member to secure the second member and the duct together. Additional friction occurs at any point where the inner surface of the second member is in contact with the inner surface of the duct (18). The pressure tab (12) is configured such that when the second member (4) is placed within a duct, the pressure tab (12) compresses in order to enhance the frictional interface between the duct and the second member.

In this embodiment, the lower portion of the second member, which contains at least one pressure tab, can be inserted directly into the exhaust duct located on a surface or wall that exhausts through a vent hood. The lower portion that goes directly into the exhaust duct does not require a clamp if it is inserted into a rigid duct as a result of the physical contact between the exhaust duct and the pressure tab, which frictionally engages the exhaust duct and the lower portion. The upper portion of the exhaust duct may use a clamp for a secure connection in the event the upper portion is inserted into a semi-rigid duct. In this embodiment, the need for the first member is eliminated, or the second member can be used to retrofit a female portion for a different vent connection means. Further, the above type of installation or connection is an alternative to connecting the male piece to the female piece that can also go into the exhaust duct in the wall (e.g., for new home installation).

In the event the second member and the duct need to be disengaged, the duct can removed from the second member by simply pulling the second member and the duct away from each other with sufficient force to overcome the frictional engagement between the surfaces of the duct and the second member that are in contact with each other, including the pressure tab or pressure tabs. Similarly, in the event the second member needs to be disengaged with the exhaust duct, the second member can be pulled away from the exhaust duct with sufficient force to overcome the frictional engagement between the surfaces of the exhaust duct and the second member that are in contact with each other, including the pressure tab or pressure tabs.

While various embodiments of the present invention have been described, it will be apparent to those of skill in the art that many more embodiments and implementations are possible that are within the scope of this invention, including for example the type of material used to make the connectors. Accordingly, the present invention is not to be restricted except in light of the attached claims and their equivalents.

What is claimed is:

1. A duct connector comprising:

a first member having a first cylindrical portion and an edge, wherein the first cylindrical portion includes a first inner side, wherein the edge is perimetrically raised from the first inner side;

a second member having a second cylindrical portion and a rib, wherein the second cylindrical portion includes an outer side, wherein the rib is perimetrically raised from the outer side such that the rib perimetrically divides the outer side into a first outer side portion and a second outer side portion, wherein the first outer side portion includes a first pressure tab having a first dimple, wherein the second outer side portion includes a second pressure tab having a second dimple, wherein the first pressure tab is configured to frictionally engage with the first inner side via the first dimple when the second cylindrical portion is positioned within the first cylindrical portion up to the edge such that the first inner side faces the first outer side portion and such that the rib engages the first cylindrical portion, wherein the first pressure tab is configured to frictionally disengage from the first inner side via the first dimple when the first cylindrical portion and the second cylindrical portion are pulled apart from each other in opposing directions with sufficient force to overcome the first pressure tab engaging the inner side via the first dimple, wherein the second pressure tab is disengagably engaging a second inner side of an exhaust duct via the second dimple, wherein the exhaust duct is in exhaust fluid communication with a dryer;

further comprising: a flange extending from the first cylindrical portion such that the flange and the first cylindrical portion form a T-shape cross-sectionally, wherein the flange engages the rib when the first outer side portion faces the first inner side, wherein the flange is adapted to be attached to a surface;

wherein the first member further comprises a groove that corresponds to the first pressure tab, wherein the first inner side comprises the groove; and wherein at least one of the first pressure tab or the second pressure tab is U-shaped.

2. The duct connector according to claim 1, wherein the edge is at least one of beveled or chamfered.

3. The duct connector of claim 1, wherein the first outer side includes a third pressure tab having a third dimple that disengagably engages the first inner side when the first outer side portion faces the first inner side.

4. The duct connector of claim 1, wherein the first pressure tab and the second pressure tab are bilaterally symmetrical with respect to the rib.

5. The duct connector of claim 1, wherein the first pressure tab opposes the second pressure tab.

* * * * *